US009279093B2

(12) United States Patent
Gieselman et al.

(10) Patent No.: US 9,279,093 B2
(45) Date of Patent: Mar. 8, 2016

(54) LUBRICATING COMPOSITION CONTAINING AN AROMATIC COMPOUND

(71) Applicant: The Lubrizol Corporation, Wickliffe, OH (US)

(72) Inventors: Matthew D. Gieselman, Wickliffe, OH (US); Seth L. Crawley, Mentor, OH (US); David J. Moreton, Milford (GB); Paul R. Stevenson, Belper (GB); Jeffry G. Dietz, Shaker Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/840,635

(22) Filed: Aug. 31, 2015

(65) Prior Publication Data

US 2016/0002564 A1 Jan. 7, 2016

Related U.S. Application Data

(62) Division of application No. 13/515,529, filed as application No. PCT/US2010/060907 on Dec. 17, 2010, now Pat. No. 9,150,813.

(60) Provisional application No. 61/287,355, filed on Dec. 17, 2009.

(51) Int. Cl.

| | |
|---|---|
| ***C10M 129/70*** | (2006.01) |
| ***C10M 129/76*** | (2006.01) |
| ***C10M 137/10*** | (2006.01) |

(52) U.S. Cl.

CPC ..... *C10M 129/70* (2013.01); *C10M 129/76* (2013.01); *C10M 2203/1006* (2013.01); *C10M 2207/026* (2013.01); *C10M 2207/284* (2013.01); *C10M 2215/064* (2013.01); *C10M 2215/082* (2013.01); *C10M 2219/046* (2013.01); *C10M 2219/06* (2013.01); *C10M 2223/045* (2013.01); *C10N 2230/06* (2013.01); *C10N 2230/10* (2013.01); *C10N 2230/12* (2013.01); *C10N 2230/36* (2013.01); *C10N 2230/54* (2013.01); *C10N 2240/102* (2013.01); *C10N 2240/104* (2013.01); *C10N 2240/105* (2013.01)

(58) Field of Classification Search

CPC ..... C10M 129/70; C10M 129/76; C10M 2203/1106; C10M 2207/026; C10M 2207/284; C10M 2215/064; C10M 2215/082; C10M 2219/06; C10M 2219/046; C10M 2223/045; C10N 2230/06; C10N 2230/10; C10N 2230/12; C10N 2230/36; C10N 2230/54; C10N 2240/102; C10N 2240/104; C10N 2240/105

USPC ..... 508/502, 370, 571, 561

See application file for complete search history.

(56) References Cited

U.S. PATENT DOCUMENTS

| | | | | |
|---|---|---|---|---|
| 2,429,905 | A | 10/1947 | Wright et al. | |
| 2,831,810 | A * | 4/1958 | Wilson | C10M 135/10 508/355 |
| 3,914,179 | A | 10/1975 | Byford et al. | |
| 4,632,771 | A | 12/1986 | Liston et al. | |
| 7,635,669 | B2 | 12/2009 | Culley | |
| 2005/0181957 | A1 * | 8/2005 | Koshima et al. | C07D 207/412 508/192 |
| 2006/0019840 | A1 * | 1/2006 | Kawahara et al. | C10M 169/04 508/280 |
| 2006/0027361 | A1 * | 2/2006 | Hanson et al. | C10L 1/003 166/261 |
| 2007/0135318 | A1 | 6/2007 | Singh et al. | |

FOREIGN PATENT DOCUMENTS

| | | |
|---|---|---|
| EP | 0877074 | 11/1998 |

* cited by examiner

*Primary Examiner* — James Goloboy

(74) *Attorney, Agent, or Firm* — Deron A. Cook, Esq.; David M. Shold, Esq.

(57) ABSTRACT

The invention provides a lubricating composition containing an aromatic compound and an oil of lubricating viscosity. The invention further relates to the use of the lubricating composition in an internal combustion engine. The invention further relates to the use of the aromatic compound as an antiwear agent.

14 Claims, No Drawings

LUBRICATING COMPOSITION CONTAINING AN AROMATIC COMPOUND

CROSS REFERENCE TO RELATED APPLICATION

This application is a Divisional Application of U.S. application Ser. No. 13/515,529 filed Sep. 24, 2012, which claims benefit to PCT Application No. PCT/US2010/060907 filed Dec. 17, 2010, which claims the benefit of U.S. Provisional Application No. 61/287,355 filed Dec. 17, 2009.

FIELD OF INVENTION

The invention provides a lubricating composition containing an aromatic compound and an oil of lubricating viscosity. The invention further relates to the use of the lubricating composition in an internal combustion engine. The invention further relates to the use of the aromatic compound as an antiwear agent.

BACKGROUND OF THE INVENTION

It is well known for lubricating oils to contain a number of surface active additives (including antiwear agents, dispersants, or detergents) used to protect internal combustion engines from corrosion, wear, soot deposits and acid build up. Often, such surface active additives can have harmful effects on engine component wear (in both iron and aluminium based components), bearing corrosion or fuel economy. A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and copper corrosion. Consequently, engine lubricants may also contain a friction modifier to obviate the detrimental impact of ZDDP on fuel economy and corrosion inhibitors to obviate the detrimental impact of ZDDP on copper corrosion. Friction modifiers and other additives may also increase lead corrosion.

Further, engine lubricants containing phosphorus and sulphur compounds such as ZDDP have been shown to contribute in part to particulate emissions and emissions of other pollutants. In addition, sulphur and phosphorus tend to poison the catalysts used in catalytic converters, resulting in a reduction in performance of said catalysts.

There has been a commercial trend for reduction in emissions (typically reduction of NOx formation, SOx formation) and a reduction in sulphated ash in engine oil lubricants. Consequently, the amounts of phosphorus-containing antiwear agents such as ZDDP, overbased detergents such as calcium or magnesium sulphonates and phenates have been reduced. As a consequence, ashless additives have been contemplated to provide friction or antiwear performance. It is known that surface active ashless compounds such as ashless friction modifiers may in some instances increase corrosion of metal, namely, copper or lead. Copper and lead corrosion may be from bearings and other metal engine components derived from alloys using copper or lead. Consequently, there may be a need to reduce the amount of corrosion caused by ashless additives.

U.S. Pat. No. 3,790,478 discloses an aero gas turbine lubricant containing hindered ester base-stock, an alkylated dithenylamine, and an alkylated phenyl naphthylamine. The lubricant contains 0.01 wt % to 1 wt % of a $C_{1-20}$ alkyl gallate as lead corrosion inhibitor (in particular propyl gallate is mentioned).

British Patent 1 358 046 discloses a lubricant 0.01 wt % to 1 wt % of a $C_{1-20}$ alkyl gallate as lead corrosion inhibitor (in particular propyl gallate is mentioned).

British Patent GB 1 180389 discloses synthetic lubricating compositions useful for the lubrication of engines of jet aircraft. The lubricants contain 0.1 wt % of propyl gallate as a lead corrosion inhibitor.

British Patent GB 1 180 386 discloses an aero gas turbine lubricant. The lubricant contains 0.01 wt % to 1 wt % of a $C_{1-20}$ alkyl gallate as lead corrosion inhibitor (in particular propyl gallate is mentioned with a treat rate of 0.1 wt %).

British Patent GB 1 162 818 discloses synthetic lubricants for use at very high temperatures that occur in area gas turbines. The lubricant contains 0.01 wt % to 1 wt % of a $C_{1-20}$ alkyl gallate as lead corrosion inhibitor (in particular propyl gallate is mentioned with a treat rate of 0.1 wt %).

French Patent FR 2063994 discloses lubricants stabilised against aging by adding 0.2 wt % to 1 wt % of a synergistic mixture of antioxidants based on (i) an ester-substituted phenol and a pentaerythritol phosphite-propyl gallate. The pentaerythritol phosphite-propyl gallate is treated at 0.2 wt % in the examples.

French Patent FR 1 537 892 discloses synthetic lubricants for use at very high temperatures that occur in area gas turbines. The lubricant contains 0.01 wt % to 1 wt % of a $C_{1-20}$ alkyl gallate as lead corrosion inhibitor (in particular propyl gallate is mentioned with a treat rate of 0.1 wt %).

U.S. Pat. No. 3,336,349 discloses alkanoyl esters of trihydroxy benzenes in lubricants to provide thermal and oxidative stability. The lubricants are useful for jet engines.

U.S. Pat. Nos. 7,423,000 and 7,582,126 disclose compositions that may contain catechol compounds such as tertiary alkyl substituted catechols.

U.S. Pat. No. 5,576,274 discloses fuel and lubricant additives useful as dispersants and multifunctional viscosity modifiers wherein a dihydroxyaromatic compound is alkylated with an olefinic polymer and then aminated in such a manner as to oxidize the hydroxyl moieties of the dihydroxyaromatic compound to carbonyl groups.

U.S. Pat. No. 2,795,548 discloses the use of lubricating oil compositions containing a borated alkyl catechol. The oil compositions are useful in the crankcase of an internal combustion engine in order to reduce oxidation of the oil and corrosion and wear of the metal parts of the engine.

U.S. Pat. No. 5,102,569 discloses a method of preparing a borated alkyl aromatic polyol. The borated alkyl aromatic polyol may be used in lubricating oil formulations to reduce oxidation, wear, and deposits in internal combustion engines.

US Patent Application 2006/019840 discloses lubricating oil for bearings, in particular, a lubricating oil for oil impregnated sintered bearings or fluid dynamic bearings. The lubricating oil may contain gallic acid-based compounds.

SUMMARY OF THE INVENTION

The inventors of this invention have discovered a lubricating composition that is capable of providing at least one of antiwear performance, friction modification (particularly for enhancing fuel economy), extreme pressure performance, antioxidant performance, lead, tin or copper (typically lead) corrosion inhibition, decreased corrosiveness towards acrylate or fluoro-elastomer seals, or seal swell performance.

As used herein reference to the amounts of additives present in the lubricating composition disclosed herein are quoted on an oil free basis i.e., amount of actives.

In one embodiment the present invention provides a lubricating composition comprising an oil of lubricating viscosity and an aromatic compound of formula (1):

formula (1)

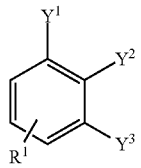

wherein $R^1$ may be a linear or branched hydrocarbyl group containing 1 to 350 carbon atoms, or —C(O)$XR^3$, or —CH═CHC(O)—$XR^3$, —C($R^6$)$_2$C($R^6$)$_2$C(O)—$XR^3$ (such as —$CH_2CH_2$C(O)—$XR^3$), (typically $R^1$ may be a hydrocarbyl group derived from a polyalkene, or —C(O)$XR^3$);

each $Y^1$, $Y^2$ and $Y^3$ may be independently —H or —$OR^2$ with the proviso that at least two of $Y^1$, $Y^2$ and $Y^3$ are —$OR^2$ and where at least two (or three of) —$OR^2$ groups are adjacent to one another;

$R^2$ may be independently hydrogen or a linear or branched hydrocarbyl group containing 1 to 10 carbon atoms;

$R^3$ may be a linear or branched hydrocarbyl group (typically alkyl, aryl, alkaryl, alkoxy, aryloxy);

X may be —O—, —S—, or >$NR^4$, (typically X may be —O—, or >$NR^4$);

$R^4$ may be hydrogen or a linear or branched hydrocarbyl group containing 1 to 5, or 1 to 2 carbon atoms, (typically $R^4$ is hydrogen);

each $R^6$ may be hydrogen, —CN, $NH_2$, an ester group —C(O)O—$R^7$, or mixtures thereof;

$R^7$ may be hydrogen or a hydrocarbyl group containing 1 to 30, or 6 to 20, or 8 to 15 carbon atoms; and the sum of carbon atoms on $R^1$, $R^2$, $R^3$, $R^4$ may typically at least 1, or at least 6, or at least 8.

When $R^1$ is a —CH═CHC(O)—$XR^3$ group, the compound of formula (1) may be a derivative of 3,4,5-trihydroxy-trans-cinnamic acid, or mixtures thereof.

When two adjacent Y groups of formula (1) have $R^2$ defined as a linear or branched hydrocarbyl, $R^2$ may be alicyclic or form a cyclic. A cyclic structure may be formed structure for instance by aldehyde (such as formaldehyde, or a reactive equivalent thereof e.g., paraformaldehyde) or ketone bridging. The resultant compound may be represented by formula (1a):

Formula (1a)

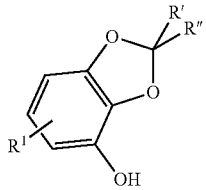

wherein $R^1$ is defined above; and R' and R" may be independently hydrogen or a hydrocarbyl group containing 1 to 9 carbon atoms (typically R' and R" may be hydrogen).

In one embodiment the aromatic compound of formula (1) has $Y^1$, $Y^2$ and $Y^3$ defined as —$OR^2$ where each $R^2$ is independently hydrogen or a linear or branched hydrocarbyl group containing 1 to 10 carbon atoms (typically hydrogen), $R^1$ is —C(O)$XR^3$, resulting in an aromatic compound of formula (2a) or (2b):

formula (2a)

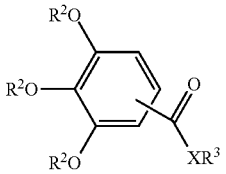

or formula (2b)

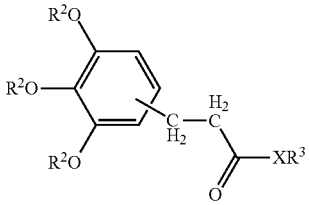

The $R^3$ group of formula (2b) may include methyl, ethyl, 2-ethylhexyl, 2-phenylethyl, or mixtures thereof In one embodiment the present invention provides a lubricating composition comprising an oil of lubricating viscosity and an aromatic compound of formula (3):

formula (3)

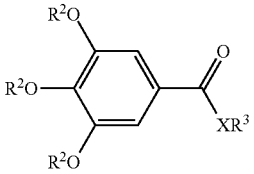

wherein each $R^2$ may be independently hydrogen or a hydrocarbyl group containing 1 to 10 carbon atoms; and where at least two (or three of) —$OR^2$ groups are adjacent to one another;

$R^3$ may be a linear or branched hydrocarbyl group (typically alkyl, aryl, alkaryl, alkoxy, aryloxy). $R^3$ may contain 1 to 40, 3 to 30, 4 to 30, 5 to 30, 6 to 30, 8 to 24, 8 to 20, 8 to 18, 5 to 10, or 10 to 18 carbon atoms;

X may be —O—, —S—, or >$NR^4$, (typically X is —O—, or >$NR^4$);

$R^4$ may be hydrogen or a linear or branched hydrocarbyl group containing 1 to 5, or 1 to 2 carbon atoms, (typically $R^4$ is hydrogen); and the sum of carbon atoms on $R^2$, $R^3$, $R^4$ may be at least 1, at least 6, or at least 8.

In one embodiment the present invention provides a lubricating composition comprising an oil of lubricating viscosity and an aromatic compound of formula (4) (may also be refereed to as a nitrogen-free additive):

Formula (4)

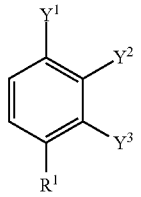

wherein $R^1$ may be a linear or branched hydrocarbyl group containing 1 to 350 carbon atoms, (typically may be a hydrocarbyl group derived from a polyalkene);

each $Y^1$, $Y^2$ and $Y^3$ may be independently —H or —$OR^2$, $R^2$ may be independently hydrogen or a hydrocarbyl group containing 1 to 10 carbon atoms; so long as at least two of $Y^1$, $Y^2$ and $Y^3$ are —$OR^2$ and where at least two —$OR^2$ groups are adjacent to one another.

In one embodiment $R^2$ in formula (1) to (4) may be hydrogen.

In one embodiment the compound of the invention may be a derivative of formulae (2a), (2b) and (3) (typically formulae (2a) and (3)).

In one embodiment the compound of the invention may be present in a lubricating composition in a range of 0.01 wt % to 10 wt %, 0.1 wt % to 8 wt %, or 0.5 wt % to 7 wt % of the lubricating composition.

In one embodiment the compound of the invention may be borated or non-borated. For compounds of formula (4), typically non-borated. Borating agents are known in the art and include boric acid, boron trioxide, or borate esters. Borating may occur by reacting the aromatic compound of formula (1) with the borating agent at a reaction temperature of 80° C. to 200° C., or 100° C. to 160° C.

In one embodiment the compound of the invention (typically a compound derived from formulae (2a), (2b) and/or (3)) may be present in a lubricating composition in a range of 0.01 wt % to 5 wt %, or 0.1 wt % to 4 wt %, or 0.2 wt % to 3 wt %, or 0.5 wt % to 2 wt % of the lubricating composition.

In one embodiment the compound of the invention (typically a compound derived from formula (4) may be present in a lubricating composition in a range of 0.01 wt % to 10 wt %, 0.1 wt % to 8 wt %, or 1 wt % to 7 wt %, or 2 wt % to 6 wt % of the lubricating composition.

In one embodiment the lubricating composition of the invention further includes an antiwear agent such as a metal dihydrocarbyl dithiophosphate (typically zinc dialkyldithiophosphate), wherein the metal dihydrocarbyl dithiophosphate contributes at least 100 ppm, or at least 200 ppm, or 200 ppm to 1000 ppm, or 300 ppm to 800 ppm, or 400 ppm to 600 ppm of phosphorus to the lubricating composition.

In one embodiment the invention provides a method of lubricating an internal combustion engine comprising supplying to the internal combustion engine a lubricating composition as disclosed herein.

In one embodiment the invention provides for the use of the aromatic compounds of the invention as at least one of an antioxidant, a dispersant, an antiwear agent, friction modifier, extreme pressure agent, lead, tin or copper (typically lead) corrosion inhibition, decreased corrosiveness towards acrylate or fluoro-elastomer seals, or seal swell performance.

In one embodiment the invention provides for the use in a lubricant of the aromatic compounds of the invention as at least one of an antioxidant, a dispersant, an antiwear agent, friction modifier, extreme pressure agent, or lead, tin, or copper (typically lead) corrosion inhibitor, decreased corrosiveness towards acrylate or fluoro-elastomer seals, or seal swell performance in an internal combustion engine.

In one embodiment the invention provides for the use in a lubricant of the aromatic compounds of the invention as at least one of an antioxidant, a dispersant, an antiwear agent, friction modifier, extreme pressure agent, or lead, tin, or copper (typically lead) corrosion inhibitor in an internal combustion engine.

In one embodiment the invention provides for the use in a lubricant of the aromatic compounds of formulae (2a), (2b) and/or (3) as at least one of an antiwear agent, friction modifier, extreme pressure agent, or lead, tin, or copper (typically lead) corrosion inhibitor in an internal combustion engine. Typically, the aromatic compounds of formulae (2a), (2b) and/or (3) may be an antiwear agent in an internal combustion engine.

In one embodiment the invention provides for the use in a lubricant of the aromatic compounds of formula (4) as at least one of an antioxidant, and/or a dispersant and/or for lead corrosion inhibition in an internal combustion engine. Typically the aromatic compounds of formula (4) may have antioxidant and/or dispersant properties. The dispersant properties may also decrease corrosiveness towards acrylate or fluoro-elastomer seals.

DETAILED DESCRIPTION OF THE INVENTION

The present invention provides a lubricating composition, a method for lubricating an engine as disclosed above, and the use of the compounds as disclosed above.

The aromatic compound of formula (1) may be a derivative of gallic acid, pyrocatechol, pyrogallol, 1,2-di-methoxybenzene, 1,3-dimethoxybenzene, 1,2,3 trimethoxybenzene, or mixtures thereof. Typically, the aromatic compound of formula (1) may be a derivative of gallic acid, pyrocatechol, 1,2-di-methoxybenzene, 1,3-dimethoxybenzene, 1,2,3 trimethoxybenzene, or mixtures thereof. The aromatic compound of formula (1) may be trihydroxy compound (i.e., wherein $Y^1$, $Y^2$ and $Y^3$ are —$OR^2$).

Typically the compounds of formulae (2a), (2b) and (3) may be a gallic acid ester, or gallic acid amide. In one embodiment the compounds of formulae (2a), (2b) and (3) may be a derivative of gallic acid, or mixtures thereof In one embodiment formulae (2a), (2b) and (3) may have $R^3$ defined as and alkyl, aryl, alkaryl, alkoxy, aryloxy group, or mixtures thereof. Typically, $R^3$ may be an alkyl group.

The gallic acid esters of formulae (2a), (2b) and (3), wherein $R^3$ may be an alkyl group are well known in the art. For example octyl gallate is a food preservative E311. Other gallic acid esters include propyl gallate, 2-methylpropyl gallate, butyl gallate, tert-butyl gallate, pentyl, isoamyl gallate (may also be referred to as 3-methyl-1-butyl gallate), 2-ethyhexyl gallate, nonyl gallate, decyl gallate, undecyl gallate, dodecyl gallate (may also be referred to as lauryl gallate), tridecyl gallate, tetradecyl gallate (may also be referred to as myristic gallate), pentadecyl gallate, hexadecyl gallate (may also be referred to as palmitic gallate), heptadecyl gallate, octadecyl gallate (may also be referred to as stearyl gallate), nonadecyl gallate, eicosyl gallate, or mixtures thereof.

In different embodiments the gallic acid ester may have $R^3$ defined as an alkyl group containing 8 to 18, or 5 to 10 carbon atoms.

When $R^3$ is an alkoxy group useful alkoxy groups include methoxy group, an ethoxy group, a propoxy group, a butoxy group, a pentyloxygroup, a hexyloxy group, or mixtures thereof.

The gallic acid esters may also be in the form of mixtures. The mixtures may be obtained from esterification of gallic acid with fatty alcohols. The fatty alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

The compounds of formula (4) may be a derivative of pyrocatechol, resorcinol, pyrogallol, 1,2-di-methoxybenzene, 1,3-dimethoxybenzene, 1,2,3-trimethoxybenzene, or mixtures thereof.

In one embodiment the aromatic compound of formula (4) may also be represented by compounds of formula (5):

formula (5)

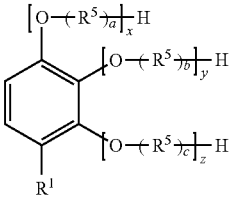

wherein: $R^1$ is as defined above; each $R^5$ may be independently a hydrocarbylene group containing 1 to 50, 1 to 25, 1 to 10, or 1 to 6 carbon atoms; a, b and c may be independently 0 or 1; x, y and z are each independently 0 or 1; so long as the additive contains at least two substituent groups (that is not merely an —H) other than $R^1$ and where the two substituent groups are adjacent to one another.

The mole percent of the compound of formulae (4) or (5) formed by reacting the hydrocarbyl-substituted hydroxy aromatic compound with the aldehyde may be 10 mol % to 100 mol %, or 25 mol % to 99 mol %, or 50 mol % to 99 mol %.

In one embodiment the aromatic compound of formula (4) may be prepared by reacting a substituted aromatic compound with a polyalkene. The reaction may optionally be carried out in the presence of a solvent as well as a catalyst. When a catalyst is used, a deactivator may be added at the end of the reaction. The resulting product may be filtered.

In one embodiment, substituted aromatic compound may be a hydroxy substituted aromatic compound, an ether and/or alkyloxy substituted aromatic compound, or combination thereof. In different embodiments the aromatic compound of the present invention includes at least two substituent groups where the substituent groups are —OH, —OR, or mixtures thereof, wherein R is a hydrocarbyl group. In different embodiments R contains from 1 to 10, 1 to 6 or 1 to 4 carbon atoms. Within any of the aromatic compounds described herein, the substituent groups are typically adjacent to one another or may have one open position between them. For example, the substituent groups may be present in positions 1 and 2, 1 and 3 or 1, 2 and 3 on the aromatic ring of the compound.

The aromatic compound may be a hydroxy aromatic compound, and more specifically, a polyhydroxy aromatic compound, including both dihydroxy and trihydroxy aromatic compounds. In one embodiment the hydroxy aromatic compound of formula (4) may be pyrocatechol, resorcinol, pyrogallol, or mixtures thereof.

In one embodiment the aromatic compound may be an ether-containing aromatic compound, and more specifically, a polyether aromatic compound. In one embodiment the hydroxy aromatic compound may be 1,2-di-methoxybenzene, 1,3-dimethoxybenzene, 1,2,3 trimethoxybenzene. In one embodiment the compounds of the present invention contains two or three substituents groups where each substituents group is independently a hydroxyl group, a methoxy group, an ethoxy group, a propoxy group, a butoxy group, a pentyloxygroup, a hexyloxy group, or mixtures thereof.

The polyalkene used to prepare the compound of formulae (4) and (5) generally attaches in the para position, or, as in line with the position description for the substituent groups above, position 4 on the aromatic ring of the compound (however the group may also be present in position 3, depending on the identity of the $Y^1$ group). During the reaction the polyalkene attaches to the aromatic ring of the compound, forming a hydrocarbyl substituent group, represented by $R^1$ in formulae (1) and (5) shown above. The polyalkene, and so the resulting hydrocarbyl group, generally contains an average of at least 4, 8, 30, or 35 up to 350, or 35 to 200, or 35 to 100 carbon atoms. The polyalkene may also contain any of the carbon atom ranges or average molecular weights described above for group $R^1$, and may comprise conventional polyisobutylene, highly reactive polyisobutylene, or mixtures thereof.

Suitable polyalkenes also include homopolymers and interpolymers of polymerizable olefin monomers of 2 to 16 or to 6, or to 4 carbon atoms. The olefins may be monoolefins such as ethylene, propylene, 1-butene, isobutylene, and 1-octene; or a polyolefinic monomer, such as diolefinic monomer, such 1,3-butadiene and isoprene. An example of a polymer is a polybutene. In one embodiment 50% of the polybutene may be a derivative of isobutylene.

In one embodiment the $R^1$ hydrocarbyl group of formulae (4) and/or (5) may be a derivative of polyalkenes having a number average molecular weight of least 250, 350, 500, or 750 to 5000, or 750 to 3000, or 750 to 2300, or 850 to 1500, or 850 to 1050. In one embodiment the polyalkene may be polyisobutylene with a molecular weight of 800 to 1200.

The aromatic compound used to prepare the aromatic compound of formula (4) may also include other polyhydroxy benzenes, an alkyl-substituted polyhydroxy benzene such as 3-methylcatechol, or mixtures thereof.

The reactants used in the presence invention may be mixed in a solvent, such as toluene to improve their handling and ease the mixing of the reaction system. Such a solvent may be separately added to the reactants and/or added directly to the reaction system.

As noted, the one step process of the present invention may be carried out in the presence of a catalyst, such as an acidic catalyst. The acidic catalyst may include for example mineral acids such as a sulphuric acid acidified clay, Lewis acid catalysts such as a complex of boron trifluoride with diethyl ether or with phenol, and acidic ion exchange resins such as the Amberlyst® series of strongly acidic macroreticular resins available from Rohm and Haas. The catalyst may also include an esterification catalyst such as toluenesulphonic acid, sulphuric acid, aluminum chloride, boron trifluoride-triethylamine, methanesulphonic acid, hydrochloric acid, ammonium sulphate, phosphoric acid, or sodium methoxide.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/

147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil. In one embodiment the oil of lubricating viscosity may be an API Group I oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives include at least one of metal deactivators, viscosity modifiers, detergents, friction modifiers (other than the compound of the present invention), antiwear agents (other than the compound of the present invention), corrosion inhibitors (other than the compound of the present invention), dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of a dispersant, an antiwear agent (other than the compound of the present invention), a dispersant viscosity modifier, a friction modifier, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

The dispersant of the present invention may be a succinimide dispersant, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be a derivative of an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof The dispersant may be a N-substituted long chain alkenyl succinimide. Examples of N-substituted long chain alkenyl succinimide include polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt % of the lubricating composition.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the invention provides a lubricating composition which further includes a phosphorus-containing antiwear agent. Typically the phosphorus-containing antiwear agent may be a zinc dialkyldithiophosphate, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased detergent. The overbased detergent may be selected from the group consisting of non-sulphur containing phenates, sulphur containing phenates, sulphonates, salixarates, salicylates, and mixtures thereof.

The overbased detergent may also include "hybrid" detergents formed with mixed surfactant systems including phenate and/or sulphonate components, e.g. phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased detergent may be a sodium, calcium or magnesium salt of the phenates, sulphur containing phenates, sulphonates, salixarates and salicylates. Overbased phenates and salicylates, typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). The predominantly linear alkylbenzene sulphonate detergent may be particularly useful for assisting in improving fuel economy. Overbased detergents are known in the art. The overbased detergent may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at or 2 wt % to 3 wt % of the lubricating composition. For a passenger car engine the detergent may be present at 0.2 wt % to 1 wt % of the lubricating composition.

In one embodiment the lubricating composition includes an antioxidant, or mixtures thereof. The antioxidant may be present at 0 wt % to 15 wt 5, or 0.1 wt % to 10 wt %, or 0.5 wt % to 5 wt % of the lubricating composition.

Antioxidants include sulphurised olefins, alkylated diphenylamines (typically dinonyl diphenylamine, octyl diphenylamine, dioctyl diphenylamine), hindered phenols, molybdenum compounds (such as molybdenum dithiocarbamates), or mixtures thereof The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of suitable friction modifiers include long chain fatty acid derivatives of amines, esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition.

In one embodiment the friction modifier may be selected from the group consisting of long chain fatty acid derivatives of amines, esters, or epoxides; fatty alkyl tartrates; fatty alkyl tartrimides; and fatty alkyl tartramides. The fatty alkyl tartrates; fatty alkyl tartrimides; and fatty alkyl tartramides.

In one embodiment the friction modifier may be a long chain fatty acid ester. In another embodiment the long chain fatty acid ester may be a mono-ester and in another embodiment the long chain fatty acid ester may be a (tri)glycerides.

Other performance additives such as corrosion inhibitors include those described in paragraphs 5 to 8 of US Application U.S. Ser. No. 05/038,319, published as WO2006/047486, octyl octanamide, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful. Foam inhibitors that may be useful in the compositions of the invention include copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Aromatic Compound of Invention (typically derived from formulae (2a), (2b) or (3)) | 0.1 to 4 | 0.2 to 3 | 0.5 to 2 |
| Dispersant | 0.05 to 12 | 0.75 to 8 | 0.5 to 6 |
| Dispersant Viscosity Modifier | 0 to 5 | 0 to 4 | 0.05 to 2 |
| Overbased Detergent | 0 to 15 | 0.1 to 10 | 0.2 to 8 |

-continued

| Additive | Embodiments (wt %) A | B | C |
|---|---|---|---|
| Antioxidant | 0 to 15 | 0.1 to 10 | 0.5 to 5 |
| Antiwear Agent | 0 to 15 | 0.1 to 10 | 0.3 to 5 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

The aromatic compound of invention (typically derived from formula (4)) may be present in embodiments (D) 0.1 wt % to 8 wt %, or (E) 1 wt % to 7 wt %, or (F) 2 wt % to 6 wt % of the lubricating composition, with the amount of dispersant viscosity modifier, overbased detergent, antioxidant, anti-wear agent, friction modifier, viscosity modifier, any other performance additive (excluding a dispersant) and an oil of lubricating viscosity in amounts shown in the table above for embodiments (A) to (C). The compound of invention derived from formula (4) may also exhibit dispersant performance. If the compound of invention derived from formula (4) exhibits dispersant performance, a portion or all of the dispersant ranges quoted in embodiments (D) to (F) may be 0 wt % to 12 wt %, or 0 wt % to 8 wt % or 0 wt % to 6 wt % of the lubricating composition.

INDUSTRIAL APPLICATION

The lubricating composition may be utilised in an internal combustion engine. The engine components may have a surface of steel or aluminium (typically a surface of steel).

An aluminium surface may be a derivative of an aluminium alloy that may be an eutectic or hyper-eutetic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The internal combustion engine of the present invention is distinct from gas turbine. In an internal combustion engine individual combustion events which through the rod and crankshaft translate from a linear reciprocating force into a rotational torque. In contrast, in a gas turbine (may also be referred to as a jet engine) it is a continuous combustion process that generates a rotational torque continuously without translation and can also develop thrust at the exhaust outlet. These differences result in the operation conditions of a gas turbine and internal combustion engine different operating environments and stresses.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulphated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment the sulphated ash content may be 0.05 wt % to 0.9 wt %, or 0.1 wt % to 0.2 wt % or to 0.45 wt %.

In one embodiment the lubricating composition may be an engine oil, wherein the lubricating composition may be characterised as having at least one of (i) a sulphur content of 0.5 wt % or less, (ii) a phosphorus content of 0.1 wt % or less, and (iii) a sulphated ash content of 1.5 wt % or less.

EXAMPLES

The following examples provide illustrations of the invention. These examples are non-exhaustive and are not intended to limit the scope of the invention.

Preparative Example 1

An additive is prepared by adding pyrocatechol (330 g; 3 moles), mixed with toluene (302 g; 3.28 moles), to a 2-liter glass reaction flask equipped with cold water condenser, caustic scrubber, subline addition tube, thermocouple, and over head mechanical stirrer. The mixture is stirred for 15 minutes under a nitrogen blanket. The catalyst $BF_3$ etherate (20.6 g; 0.145 moles) is added dropwise over 30 minutes while maintaining the reaction temperature below 25° C. Mixed vinylidene 1000 Mn polyisobutylene, TPC 1105™ available from the Texas Petrochemicals LP, (501 g; 0.50 moles) mixed with toluene (202 g; 2.19 moles), is then added drop wise over a 3 hour period maintaining the reaction temperature below 25° C. The mixture is then stirred for 22 hours at 20° C. to 25° C. Calcium hydroxide (32.3 g; 0.436 moles) is then added to quench the catalyst. The reaction mixture is then filtered and vacuum stripped to remove the solvent. The resulting product is a polyisobutylene pyrocatechol additive.

Preparative Example 2

An additive is prepared by adding pyrogallol (60 g; 0.476 moles), mixed with toluene (70 g; 0.76 moles), to a 1-liter glass reaction flask equipped with cold water condenser, caustic scrubber, subline addition tube, thermocouple, and over head mechanical stirrer. The mixture is stirred for 15 minutes under a nitrogen blanket. The catalyst $BF_3$ etherate (7.27 g; 0.051 moles) is added dropwise over 30 minutes while maintaining the reaction temperature below 25° C. Mixed vinylidene 1000 Mn polyisobutylene, TPC 1105™ available from the Texas Petrochemicals LP, (183 g; 0.183 moles) mixed with toluene (150 g; 1.63 moles), is then added drop wise over an 100 minute period maintaining the reaction temperature below 25° C. The mixture is then stirred for 24 hours at 20 to 25° C. Calcium hydroxide (15 g; 0.2 moles) is then added to quench the catalyst. The reaction mixture is then filtered and vacuum stripped to remove the solvent. The resulting product is a polyisobutylene pyrogallol additive.

Preparative Example 3

An additive is prepared by adding pyrocatechol (330 g; 3.0 moles), mixed with toluene (520 g; 5.65 moles), to a 5-liter glass reaction flask equipped with cold water condenser, caustic scrubber, subline addition tube, thermocouple, and over head mechanical stirrer. The mixture is stirred for 15 minutes under a nitrogen blanket. The catalyst $BF_3$ etherate (55.6 g; 0.39 moles) is added dropwise over 30 minutes while maintaining the reaction temperature below 25° C. Mixed vinylidene 1000 Mn polyisobutylene, TPC 1105™ available from the Texas Petrochemicals LP, (1999.7 g; 2.00 moles) mixed with toluene (975 g; 10.6 moles), is then added drop wise over a 3 hour period maintaining the reaction temperature below 25° C. The mixture is then stirred for 22 hours at 20 to 25° C. Calcium hydroxide (96 g; 1.30 moles) is then added to quench the catalyst. The reaction mixture is then filtered and vacuum stripped to remove the solvent. The resulting product is a polyisobutylene pyrocatechol additive.

Lubricant 1 (INV1) is a SAE 5W-30 is prepared containing antioxidants (mixture of hindered phenols and alkylated diphenylamines), 740 ppm of phosphorus delivered from zinc dialkyldithiophosphate, an overbased calcium sulphonate detergent, and 4.9 wt % of preparative example 1.

Lubricant INV1 is evaluated for boundary lubrication friction performance and wear in a programmed temperature high frequency reciprocating rig (HFRR) available from PCS Instruments. HFRR conditions for the evaluations were 200 g load, 75 minute duration, 1000 micrometer stroke, 20 Hertz frequency, and temperature programme of 15 minutes at 40° C., then the temperature is raised to 160° C. at a rate of 2° C./min. The contact potential is measured by applying a small electrical potential between the upper and lower test specimens. If the instrument measures the full electrical potential applied, this is indicative of an electrically insulating layer between the upper and lower test specimens, this is usually interpreted as the formation of a chemical protective film on the surfaces. If no protective film is formed there is metal to metal contact between the upper and lower test specimens and the measured electrical potential drops to zero. Intermediate values are indicative of partial or incomplete protective films. The contact potential is often presented as a percentage of the applied electrical potential and called percent film thickness. The wear, and contact potential results obtained are presented in the following table:

| Test 1: Wear Performance | |
|---|---|
| | INV1 |
| Wear Scar (μm) | 145 |
| Contact Potential | 88 |

Test 2: Wear Performance of Ester-Containing Compounds

A series of SAE 5W-30 engine lubricants (IVL2 to IVL6) are prepared containing antioxidants (mixture of hindered phenols and alkylated diphenylamines), 500 ppm of phosphorus delivered from zinc dialkyldithiophosphate, an overbased calcium sulphonate detergent, a succinimide dispersant, and further containing 0.5 wt % of the compound of the invention. In particular IVL2 contains lauryl gallate, IVL3 contains stearyl gallate, IVL4 contains octyl gallate, IVL5 contains isoamyl gallate and IVL6 contains propyl gallate.

Comparative Example 1 (CE1) is a SAE 5W-30 engine lubricant similar to IVL1, except it does not contain a compound of the present invention.

The SAE 5W-30 lubricants are evaluated for boundary lubrication friction performance and wear in a programmed temperature high frequency reciprocating rig (HFRR) available from PCS Instruments. HFRR conditions for the evaluations were 500 g load, 75 minute duration, 1000 micrometer stroke, 20 Hertz frequency, and at a temperature of 105° C. The wear and contact potential are then measured. The wear, and contact potential results obtained are presented in the following table:

| | CE1 | IVL2 | IVL3 | IVL4 | IVL5 | IVL6 |
|---|---|---|---|---|---|---|
| Wear Scar (μm) | 406 | 320 | 354 | 280 | 303 | 387 |
| Contact Potential | 2 | 43 | 12 | 67 | 59 | 30 |

The data presented indicates that the lubricating composition of the invention (for example, an internal combustion engine lubricant) containing the compound of the invention provides antiwear performance.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and an aromatic compound of formula (1):

formula (1)

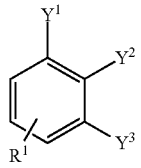

wherein $R^1$ is —CH═CHC(O)—$XR^3$;

each $Y^1$, $Y^2$ and $Y^3$ is independently —H or —$OR^2$ with the proviso that at least two of $Y^1$, $Y^2$ and $Y^3$ are —$OR^2$ and where at least two —$OR^2$ groups are adjacent to one another;

$R^2$ is independently hydrogen or a linear or branched hydrocarbyl group containing 1 to 10 carbon atoms;

$R^3$ is a linear or branched hydrocarbyl group;

X is —O—, —S—, or >$NR^4$; and $R^4$ is hydrogen or a linear or branched hydrocarbyl group containing 1 to 5 carbon atoms.

2. The lubricating composition of claim 1, wherein two of $Y^1$, $Y^2$ and $Y^3$ are $OR^2$ groups and the third of $Y^1$, $Y^2$ and $Y^3$ is hydrogen.

3. The lubricating composition of claim 2, wherein $R^2$ is hydrogen.

4. The lubricating composition of claim 3, wherein X is —O—.

5. The lubricating composition of claim 1, wherein $Y^1$, $Y^2$ and $Y^3$ are $OR^2$ groups.

6. The lubricating compositions of claim 5, wherein $R^2$ is hydrogen.

7. The lubricating composition of claim 6, wherein the aromatic compound is a derivative of 3,4,5-trihydroxy-trans-cinnamic acid.

8. The lubricating composition of claim 1, wherein the aromatic compound is present in a range of 0.01 wt % to 10 wt % of the lubricating composition.

9. The lubricating composition of claim 8, wherein the aromatic compound is present in a range of 0.5 wt % to 7 wt % of the lubricating composition.

10. The lubricating composition of claim 1, further comprising at least one of an antiwear agent, a dispersant viscosity modifier, a friction modifier, a viscosity modifier, and antioxidant, an overbased detergent, or mixtures thereof.

11. The lubricating composition of claim 1, further comprising a metal dihydrocarbyl dithiophosphate, wherein the metal dihydrocarbyl dithiophosphate contributes at least 100 ppm of phosphorus to the lubricating composition.

12. The lubricating composition of claim 11, wherein the metal dihydrocarbyl dithiophosphate is zinc dialkyldithiophosphate.

13. The lubricating composition of claim 1 further comprising an overbased detergent having a total base number of 250 to 600.

14. The lubricating composition of claim 1, wherein the oil of lubricating viscosity comprises an API Group I, or Group II or Group III oil.

* * * * *